US008770953B2

(12) United States Patent
Lee et al.

(10) Patent No.: US 8,770,953 B2
(45) Date of Patent: Jul. 8, 2014

(54) MOTOR DRIVEN FLUID PUMP

(75) Inventors: Seungyong Lee, Gyeonggi-do (KR); Chimyung Kim, Gyeonggi-do (KR); Haengjin Ko, Seoul (KR); Harkkoo Kim, Gyeonggi-do (KR); Yunseok Kim, Gyeonggi-do (KR); Yongsun Park, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 426 days.

(21) Appl. No.: 13/174,498

(22) Filed: Jun. 30, 2011

(65) Prior Publication Data

US 2012/0121445 A1 May 17, 2012

(30) Foreign Application Priority Data

Nov. 15, 2010 (KR) ..... 10-2010-0113167

(51) Int. Cl.
*F04B 35/00* (2006.01)

(52) U.S. Cl.
USPC ..... 417/423.11; 417/321; 417/423.14

(58) Field of Classification Search
USPC ..... 417/321, 423.11, 423.14
See application file for complete search history.

(56) References Cited

U.S. PATENT DOCUMENTS 5,174,583 A * 12/1992 Orlowski et al. ..... 277/421
5,660,521 A * 8/1997 Serio ..... 415/111
2006/0177325 A1* 8/2006 Peterson et al. ..... 417/423.11
2008/0008585 A1* 1/2008 Tandon ..... 415/230
2009/0016899 A1* 1/2009 Davis ..... 417/133

FOREIGN PATENT DOCUMENTS

| | | | |
|---|---|---|---|
| JP | 1982-000017 | U | 1/1982 |
| JP | 1982-00019 | U | 1/1982 |
| JP | 9060732 | A | 3/1997 |
| JP | 9-229954 | A | 9/1997 |
| JP | 11-062889 | A | 3/1999 |
| JP | 2004-316795 | A | 11/2004 |
| KR | 20-1989-0023166 | U | 12/1989 |
| KR | 10-2007-0012562 | | 1/2007 |
| KR | 10-2010-0072911 | A | 7/2010 |

* cited by examiner

*Primary Examiner* — Peter J Bertheaud
*Assistant Examiner* — Dominick L Plakkoottam
(74) *Attorney, Agent, or Firm* — Edwards Wildman Palmer LLP; Peter F. Corless

(57) ABSTRACT

Disclosed is a motor driven fluid pump (e.g., water pump) including a pump body having a motor chamber and a pump chamber; a bearing supporting a rotary shaft of a motor which extends from motor chamber to pump chamber in pump body; a mechanical seal disposed between rotary shaft of the motor and pump body and blocking motor chamber from pump chamber; a bearing guide integrally fixed to rotary shaft of the motor between bearing and mechanical seal; a fluidproof plate fixed to pump body to overlap bearing guide, perpendicular to rotary shaft of the motor; and a leachate exhaust aperture and a vapor exhaust aperture which are formed through pump body to communicate with the space between fluidproof plate and mechanical seal.

13 Claims, 4 Drawing Sheets

MOTOR DRIVEN FLUID PUMP

CROSS-REFERENCE TO RELATED APPLICATIONS

The present application claims priority to Korean Patent Application No. 10-2010-0113167 filed Nov. 15, 2010, the entire contents of which application is incorporated herein for all purposes by this reference.

BACKGROUND OF THE INVENTION

1. Field of the Invention

The present invention relates to a motor driven fluid pump, and more particularly, to a structure of discharging vapor and liquid-state fluid (e.g., water) which pass through a mechanical seal in a fluid pump having a motor chamber and a pump chamber which are divided by the mechanical seal.

2. Description of Related Art

FIG. 1 shows a motor driven fluid pump of the related art which has a motor chamber 502 where a motor 500 is disposed and a pump chamber 506 where an impeller 504 that is operated by rotational force supplied from motor 500 is disposed, in which a mechanical seal 508 is provided between pump chamber 506 and motor chamber 502 to prevent fluid from permeating to motor chamber 502 from pump chamber 506.

In this configuration, cooling fluid may leak at several cubic centimeters (cc) per hour in a vapor state or a liquid state for lubrication, through mechanical seal 508 for the structure, which corrodes the bearing supporting the rotary shaft of motor 500 to the case and reduces insulation of motor 500.

Meanwhile, a specific leachate hole is provided to discharge the fluid leaking out of mechanical seal 508, as described above; however, the leachate hole may rather allow fluid to flow inside from the outside, such that motor 500 may become wet.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

The present invention has been made in an effort to provide a motor driven fluid pump in which a rotary shaft of a motor extends from a motor chamber to a pump chamber, the rotary shaft of the motor is supported by a bearing, the motor chamber and the pump chamber are divided by a mechanical seal, and which can make the insulation of the motor stable by preventing fluid leaking out of the pump chamber through the mechanical seal from flowing into the bearing and the motor chamber, and considerably improve durability by preventing corrosion of the bearing.

An exemplary embodiment of the present invention provides a motor driven fluid pump (e.g., water pump) including a pump body having a motor chamber and a pump chamber; a bearing supporting a rotary shaft of a motor which extends from the motor chamber to the pump chamber, in the pump body; a mechanical seal disposed between the rotary shaft of the motor and the pump body and blocking the motor chamber and the pump chamber; a bearing guide integrally fixed to the rotary shaft of the motor, between the bearing and the mechanical seal; a fluidproof (e.g., waterproof) plate fixed to the pump body to overlap the bearing guide, perpendicular to the rotary shaft of the motor; and a leachate exhaust aperture and a vapor exhaust aperture formed in the pump body to communicate with a space between the fluidproof plate and the mechanical seal.

In the motor driven fluid pump according to the exemplary embodiments of the present invention, a rotary shaft of a motor extends from a motor chamber to a pump chamber, the rotary shaft of the motor is supported by a bearing, the motor chamber and the pump chamber are divided by a mechanical seal, such that it is possible to make the insulation of the motor stable by preventing fluid leaking out of the pump chamber through the mechanical seal from flowing into the bearing and the motor chamber, and considerably improve durability by preventing corrosion of the bearing.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
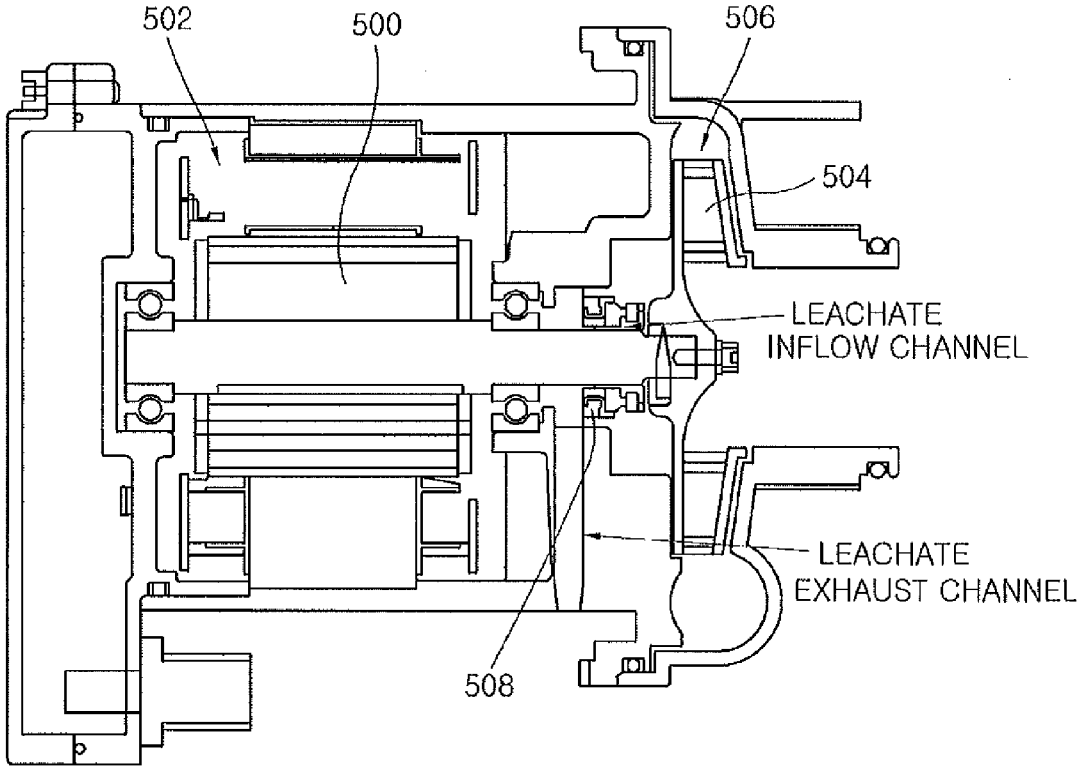
FIG. 1 is a view illustrating the structure of a motor driven fluid pump according to the related art.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 2:
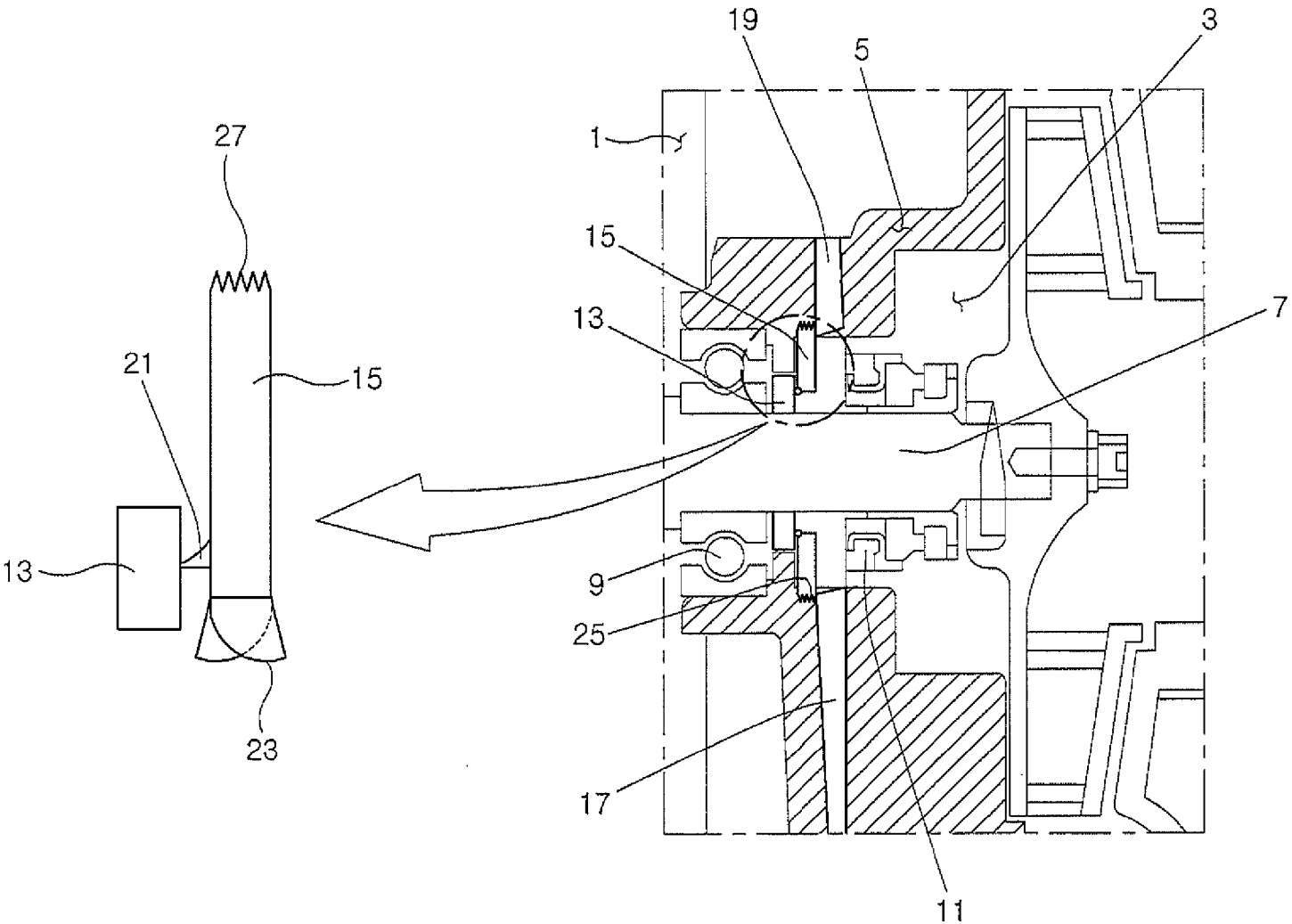
FIG. 2 is a view illustrating the structure of a motor driven fluid pump according to an exemplary embodiment of the present invention.
Figure 3:
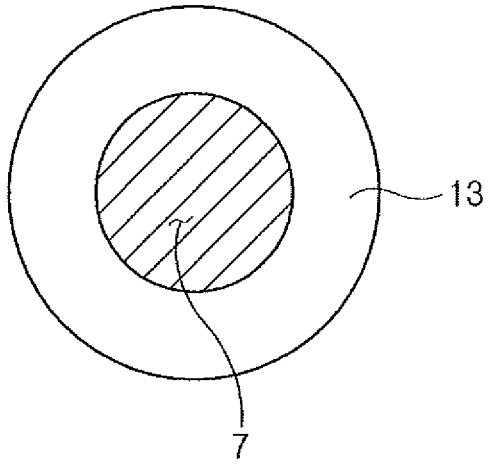
FIG. 3 is a view illustrating the structure when a bearing guide is coupled to a rotary shaft of a motor.
Figure 4:
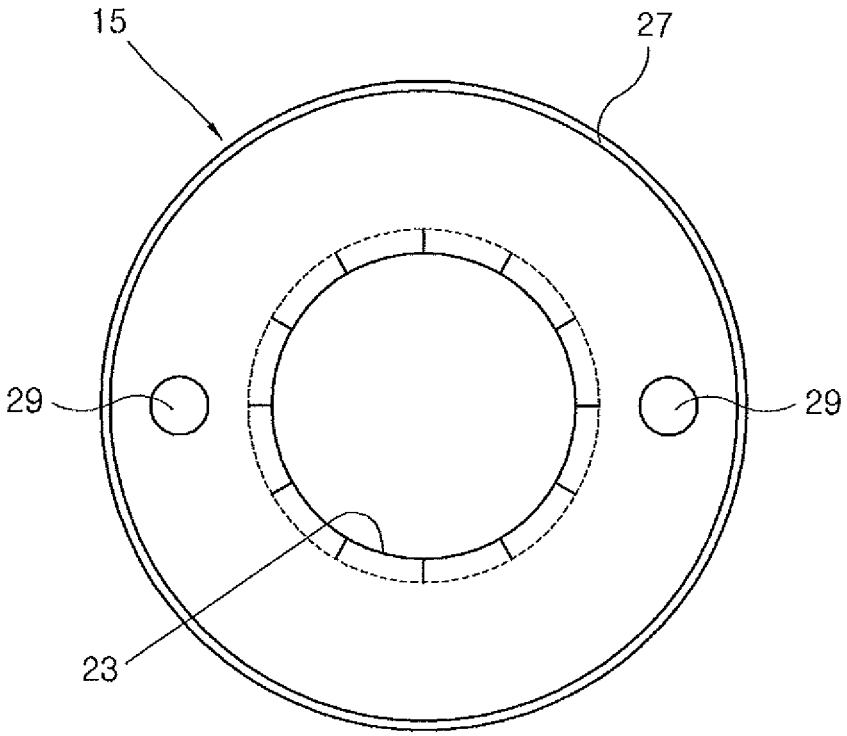
FIG. 4 is a view showing a fluidproof plate.

Referring to FIGS. 2 to 4, a motor driven fluid pump according to an exemplary embodiment of the present invention includes a pump body 5 having a motor chamber 1 (or drive chamber) and a pump chamber 3; a bearing 9 supporting a rotary shaft 7 of a motor which extends from motor chamber 1 to pump chamber 3 in pump body 5; a mechanical seal 11 disposed between rotary shaft 7 of the motor and pump body 5 and blocking motor chamber 1 from pump chamber 3 (e.g., where the term "blocking" illustratively indicates a fluidic separation between the motor chamber 1 and pump chamber 3); a bearing guide 13 integrally fixed to rotary shaft 7 of the motor between bearing 9 and mechanical seal 11; a fluidproof plate 15 fixed to pump body 5 to overlap bearing guide 13, perpendicular to rotary shaft 7 of the motor; and a leachate exhaust aperture 17 (forming a leachate exhaust hole) and a vapor exhaust aperture 19 (forming a vapor exhaust hole) which are formed through pump body 5 to communicate with the space between fluidproof plate 15 and mechanical seal 11.

That is, mechanical seal 11 between pump chamber 3 and motor chamber 1 performs the basic sealing function that allows rotary shaft 7 of the motor to rotate and prevents fluid from pump chamber 3 from flowing to motor chamber 1, a small amount of fluid passing through mechanical seal 11 is secondarily blocked by a sealed structure formed by fluidproof plate 15 and bearing guide 13, and the fluid leaking in a vapor state is discharged outside through vapor exhaust aperture 19 and the fluid leaking in a liquid state is discharged through the leachate exhaust aperture 17, such that fluid cannot permeate bearing 9 and the motor.

Bearing guide 13, as shown in detail in FIG. 3, is formed in a ring shape covering the entire outer circumference of rotary shaft 7 of the motor to ensure airtightness and fluidproof plate 15 is formed in a ring shape with an outer circumference fixed to pump body 5 and an inner circumference spaced apart from rotary shaft 7 of the motor.

Bearing guide 13 is coupled to rotary shaft 7 of the motor by fitting or welding, or integrally formed with rotary shaft 7 of the motor such that fluid cannot flow between rotary shaft 7 of the motor and bearing guide 13, and fluidproof plate 15 is spaced apart from rotary shaft 7 of the motor, but a side of fluidproof plate 15 is in contact with bearing guide 13 to prevent fluid from permeating.

In the exemplary embodiment, a protruding seal rib 21 is integrally formed on the surface opposite to bearing guide 13 of fluidproof plate 15 to seal bearing guide 13.

That is, according to one example embodiment, it is more advantageous in improving airtightness and reducing friction to implement sealing between bearing guide 13 and fluidproof plate 15 by using seal rib 21, than to implement sealing by directly contacting fluidproof plate 15 to bearing guide 13, such that seal rib 21 is integrally formed on fluidproof plate 15.

In one embodiment, seal rib 21 may be formed at bearing guide 13 and it is preferable to prepare for friction and ensure stronger airtightness by applying grease on seal rib 21.

A plurality of air motion tips 23 alternately bending to both sides of fluidproof plate 15 is circumferentially formed on the inner circumference of fluidproof plate 15.

Air motion tips 23 make the air flow on the inner circumference of fluidproof plate 15, when rotary shaft 7 of the motor rotates with bearing guide 13, such that they contribute to block or interfere with flow of fluid leaking from mechanical seal 11 to motor chamber 1 and discharge the fluid through vapor exhaust aperture 19.

Fluidproof plate 15 may be fitted or thread-fastened in pump body 5; however, in this embodiment, pump body 5 has a female thread 25 to thread-fasten fluidproof plate 15 by rotating it and a male thread 27 that is engaged with female thread 25 of pump body 5 is formed on the outer circumference of fluidproof plate 15, such that fluidproof plate 15 is thread-fastened to pump body 5.

Further, as shown in detail in FIG. 4, tool grooves 29 are formed at one side of fluidproof plate 15 to easily combine fluidproof plate 15 with pump body 5 by rotating the fluidproof plate.

In one embodiment, fluidproof plate 15 may be formed such that the outer circumference is fitted in pump body 5 and bearing guide 13 may also be fitted on rotary shaft 7 of the motor.

In the motor driven fluid pump having the configuration described above, according to an exemplary embodiment of the present invention, the impeller pumps the fluid up from pump chamber 3, using the rotational force supplied from the motor in motor chamber 1, mechanical seal 11 prevents the fluid in pump chamber 3 from leaking out of pump chamber 3 to motor chamber 1 while allowing rotary shaft 7 of the motor to freely rotate, the fluid leaking through mechanical seal 11 is blocked by the air flow generated by air motion tips 23, led to vapor exhaust aperture 19 and leachate exhaust aperture 17, and prevented again from permeating by the sealed structure between fluidproof plate 15 and bearing guide 13, such that it is possible to prevent corrosion of bearing 9 above motor chamber 1, ensure stable insulation of the motor, and ensure stable operability and durability of a motor driven fluid pump.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A motor driven fluid pump, comprising:

a pump body having a motor chamber and a pump chamber;

a bearing supporting a rotary shaft of a motor which extends from the motor chamber to the pump chamber, in the pump body;

a mechanical seal disposed between the rotary shaft of the motor and the pump body and blocking the motor chamber and the pump chamber;

a bearing guide integrally fixed to the rotary shaft of the motor, between the bearing and the mechanical seal;

a fluidproof plate fixed to the pump body to overlap the bearing guide, perpendicular to the rotary shaft of the motor; and a leachate exhaust aperture and a vapor exhaust aperture formed in the pump body to communicate with a space between the fluidproof plate and the mechanical seal;

wherein a plurality of air motion tips bending toward both sides of the fluidproof plate are alternately formed circumferentially on an inner circumference of the fluidproof plate.

2. The motor driven fluid pump as defined in claim 1, wherein the bearing guide is formed in a ring shape to hermetically cover the entire outer circumference of the rotary shaft of the motor, and the fluidproof plate is formed in a ring shape with an outer circumference fixed to the pump body and the inner circumference spaced apart from the rotary shaft of the motor.

3. The motor driven fluid pump as defined in claim 2, wherein a protruding seal rib is integrally formed on the fluidproof plate to seal the bearing guide, in the fluidproof plate.

4. The motor driven fluid pump as defined in claim 2, wherein tool grooves are formed at one side of the fluidproof plate to combine the fluidproof plate with the pump body by rotating the fluidproof plate, a female thread is formed on the pump body to thread-fasten the fluidproof plate by rotating the fluidproof plate, and a male thread is formed on the outer circumference of the fluidproof plate to be engaged with the female thread of the pump body.

5. The motor driven fluid pump as defined in claim 2, wherein the outer circumference of the fluidproof plate is fitted in the pump body, and the bearing guide is fitted on the rotary shaft of the motor.

6. The motor driven fluid pump as defined in claim 1, wherein the motor driven fluid pump is a water pump.

7. An apparatus, comprising:

a pump body having a drive chamber and a pump chamber;

a bearing supporting a rotary shaft which extends from the drive chamber to the pump chamber, in the pump body;

a mechanical seal disposed between the rotary shaft and the pump body and creating a fluidic separation between the drive chamber and the pump chamber;

a bearing guide fixed to the rotary shaft, between the bearing and the mechanical seal;

a fluidproof plate fixed to the pump body to overlap the bearing guide, perpendicular to the rotary shaft of a motor; and at least one exhaust aperture formed in the pump body to communicate with a space between the fluidproof plate and the mechanical seal;

wherein a plurality of air motion tips bending toward both sides of the fluidproof plate are alternately formed circumferentially on an inner circumference of the fluidproof plate.

8. The apparatus as defined in claim 7, wherein the at least one exhaust aperture comprises at least one of either a leachate exhaust aperture or a vapor exhaust aperture.

9. The apparatus as defined in claim 7, wherein the bearing guide is formed in a ring shape to hermetically cover the entire outer circumference of the rotary shaft, and the fluidproof plate is formed in a ring shape with an outer circumference fixed to the pump body and an inner circumference spaced apart from the rotary shaft.

10. The apparatus as defined in claim 9, wherein a protruding seal rib is integrally formed on the surface opposite to the bearing guide to seal the bearing guide, in the fluidproof plate.

11. The apparatus as defined in claim 9, wherein the outer circumference of the fluidproof plate is fitted in the pump body, and the bearing guide is fitted on the rotary shaft.

12. The apparatus as defined in claim 7, wherein the apparatus is a motor driven pump and wherein the rotary shaft is driven by the motor.

13. The apparatus as defined in claim 7, wherein the apparatus is a water pump.

* * * * *